US005356159A

United States Patent [19]

Butterfield

[11] Patent Number: 5,356,159

[45] Date of Patent: Oct. 18, 1994

[54] SNOWBOARD EQUALIZING HOOK

[76] Inventor: Kenneth J. Butterfield, 7465 Altiva Pl., La Costa, Calif. 92009

[21] Appl. No.: 156,681

[22] Filed: Nov. 22, 1993

[51] Int. Cl.[5] ..... A63C 5/06

[52] U.S. Cl. ..... 280/14.2; 280/809

[58] Field of Search ..... 280/14.2, 606, 816, 280/809, 14.3, 607; 114/39.2; 441/70

[56] References Cited

U.S. PATENT DOCUMENTS

| | | | |
|---|---|---|---|
| 3,378,275 | 4/1968 | Rockwood et al. | 280/606 X |
| 4,744,584 | 5/1988 | Monreal | 280/606 |
| 4,822,310 | 4/1989 | Parker et al. | 441/70 |
| 5,090,722 | 2/1992 | Ritchie et al. | 280/14.2 X |

FOREIGN PATENT DOCUMENTS

| | | | |
|---|---|---|---|
| 1391670 | 4/1988 | U.S.S.R. | 280/14.2 |

*Primary Examiner*—Richard M. Camby
*Assistant Examiner*—Carla Mattix
*Attorney, Agent, or Firm*—Henri J. A. Charmasson; John D. Buchaca

[57] ABSTRACT

A brace shaped and dimensioned to receive the tip of a snowboard-riding boot is swivelingly mounted on the top surface of a snowboard to facilitate the carrying of the board while riding a ski-lift with one foot fully engaged in one of the boot-binding fixture and the other foot engaged into the brace.

6 Claims, 2 Drawing Sheets

SNOWBOARD EQUALIZING HOOK

FIELD OF THE INVENTION

This invention relates to sporting goods, and more particularly to snowboards and their boot-binding fixtures.

BACKGROUND OF THE INVENTION

Snowboarding is a recreational activity which combines certain aspects of skiing, surfing, and skateboarding. It is practiced on a laminated board slightly longer than a skateboard but smaller than a surfboard where two boot-binding fixtures are permanently installed approximately 30 cms from each other along the longitudinal axis of the snowboard and in a perpendicular or slightly oblique orientation in relation to this axis.

Snowboard boot-binding fixtures do not have any automatic release system as do ski-binding fixtures. The snowboard enthusiast does not wear any rigid footwear as in skiing, but boots that have a relatively supple upper structure allowing ankle and foot movement.

Skiers usually ride a ski lift wearing their skis for they can easily walk and maintain their balance when getting on the ski lift. Snowboarders, by contrast, cannot walk to a ski-lift pickup location with both feet bound to the snowboards. They usually scoot to it one foot bound to the board, the other free. It is, thus, customary for the snowboard to be held dangling from one foot only when riding the ski lift. This, however, is a very uncomfortable position since the snowboard is then unbalanced and tends to twist down the medial aspect of the board supporting foot, which may cause a painful eversion of the foot.

Thre has been many reports of snowboard enthusiasts falling off a ski-lift while attempting to attach a binding in flight.

Getting off a ski-lift with one foot attached to the snowboard and the other loose can be hazardous due to the precarious dangling position of the board. The rider would prefer to have both feet secured to the board when getting off the ski-lift, but for safety reasons, it would be advantageous if one foot could be quickly detached from the snowboard in case of mishap during landing.

It would also be advantageous to ride a snowboard down a slope with one foot fixedly bound to the board and the other free to engage or pull away from a releasable attachment.

SUMMARY OF THE INVENTION

The principal and secondary objects of this invention are to provide a safe yet comfortable way to carry a snowboard while riding a ski lift, to be able to safely control the board with both feet upon landing, and do so without interfering with the operation of the snowboard boot-binding fixture or the down slope enjoyment of the snowboard.

These and other objects are achieved by means of an arcuate brace positioned near the medial aspect of one of the boot-binding fixtures of the snowboard. The snowboard enthusiast can carry the snowboard while riding a ski lift by sliding the tip of one boot under the arcuate brace while having his other boot fully secured in the binding fixture farthest away from the brace. For safety, the brace is releasably held in the ski lift riding position in a plane perpendicular to the surface of the board and parallel to its longitudinal axis; but can be quickly swiveled to a position whereabouts it lies in an orientation substantially parallel to that of the boot-binding fixtures.

DESCRIPTION OF THE PREFERRED EMBODIMENT OF THE INVENTION

Figures 1, 2, 3, 4, 5:
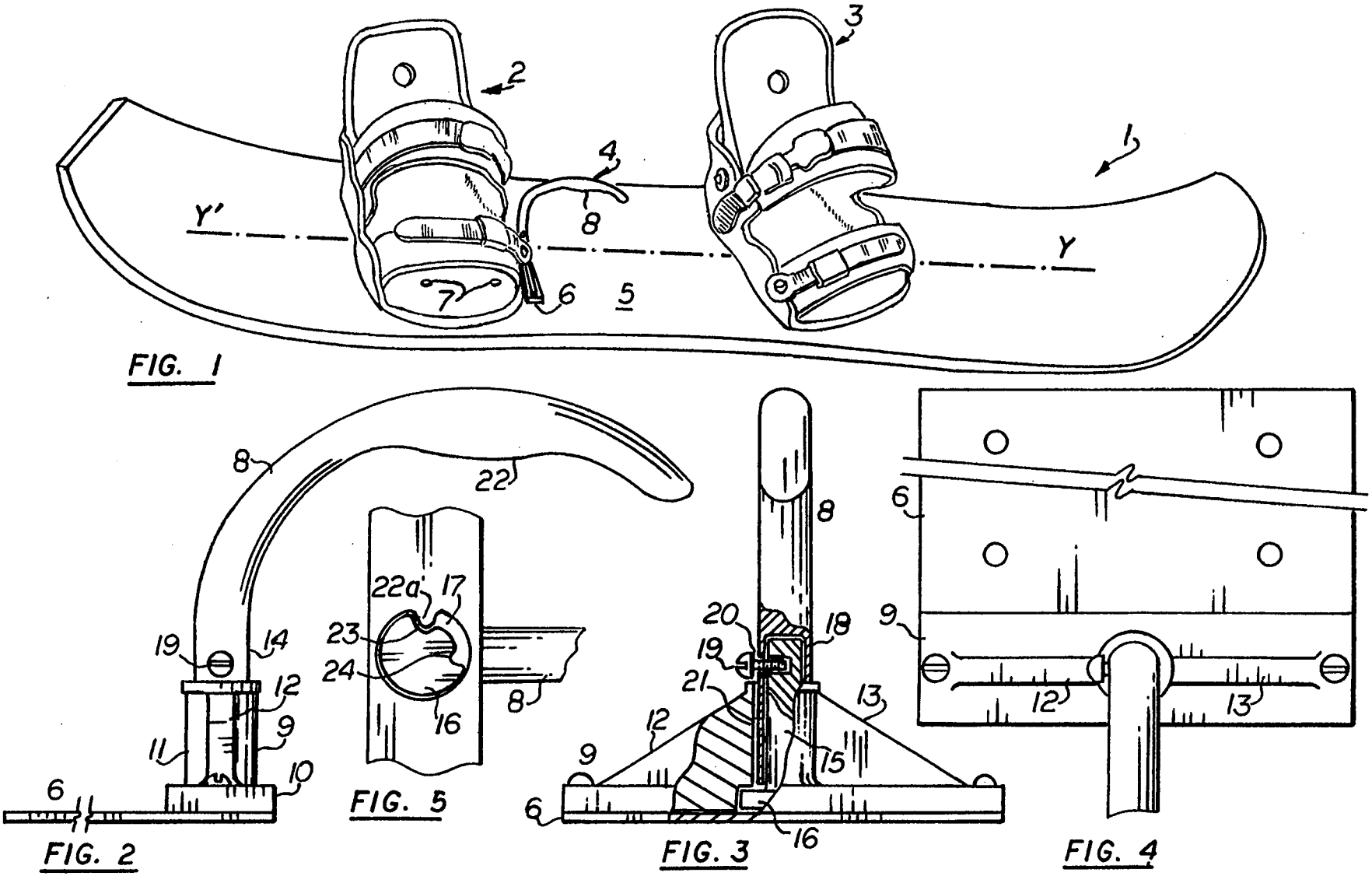
FIG. 1 is a perspective view of a snowboard equipped with a supporting hook according to the invention.
FIG. 2 is a side elevational view of the hook assembly.
FIG. 3 is a front elevational view thereof with cutoffs exposing the internal mechanism.
FIG. 4 is a top plane view thereof.
FIG. 5 is a partial bottom view of the swiveling mechanism.
Figure 7:
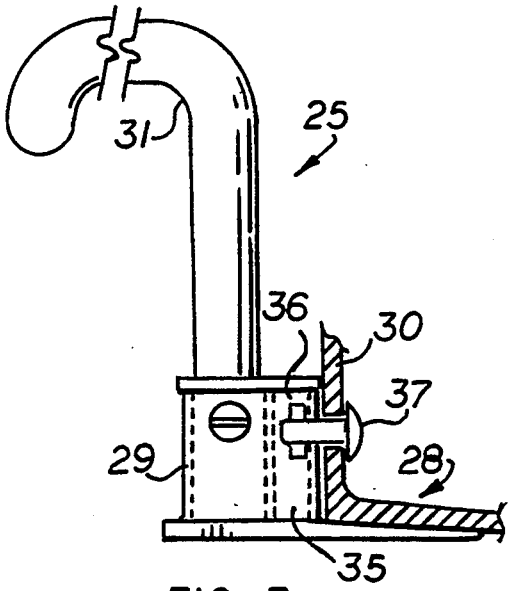
FIG. 7 is a side elevational view thereof showing attachment to a boot-binding fixture.
Figure 6:
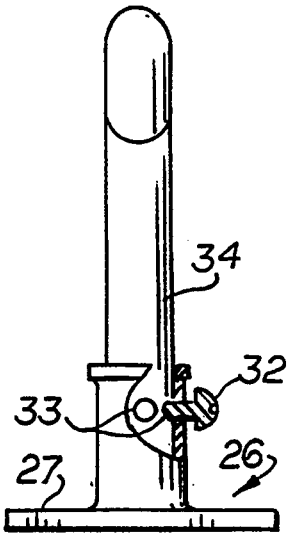
FIG. 6 is a front elevational view of an alternate embodiment of the invention.
Figure 8:
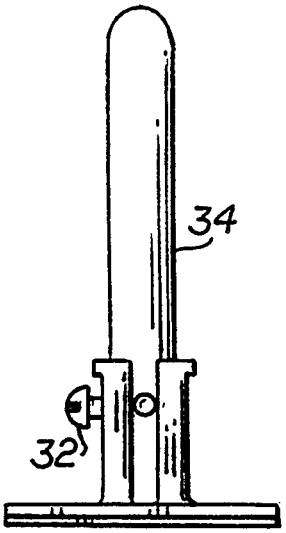
FIG. 8 is a back elevational view thereof.
Figure 9:
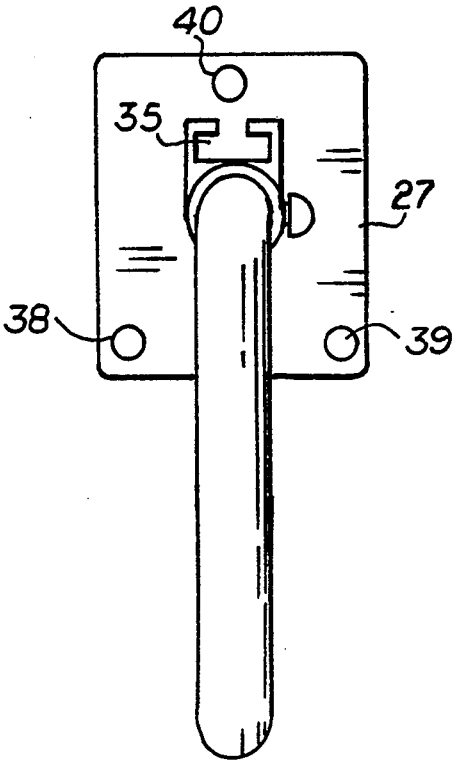
FIG. 9 is a top plan view thereof.

Referring now to the drawing, there is shown in FIG. 1, a snowboard 1 equipped with a right foot boot-binding fixture 2, a left foot boot-binding fixture 3 and a first embodiment of a hook assembly 4 according to the invention. The boot-binding fixtures are oriented in an oblique direction in relation to the longitudinal axis Y—Y′ of the snowboard slightly off the perpendicular position. The hook assembly is installed near the medial aspect of the right boot-binding fixture 2 and secured to the upper surface 5 of the snowboard by means of a sole plate 6 which extends under the right boot-binding fixture 2 where it is engaged by the binding fixture fasteners 7. The arcuate brace 8 is shown in the riding position, lying in a plane which is perpendicular to the top surface of the snowboard 5 and parallel to the longitudinal axis Y—Y′. Alternately, as will be explained below, the brace 8 can be swiveled toward the tip of the boot-binding fixture to lie in a plane perpendicular to the longitudinal axis of the board.

The brace assembly 4 is illustrated at a larger scale in FIGS. 2–5. The assembly comprises a base 9 preferably made of cast metal. The base comprises a rectangular sole 10 and a vertical tubular pillar 11 extending above the center of the sole. The pillar 11 is braced by two triangular gussets 12, 13. The sole 9 is bolted to the plate 6 designed to extend under a boot-binding fixture. The pillar has a central tubular cavity which is penetrated from the top by the shank 14 of the hook 8 and, from the bottom, by a plug 15 which acts as a fastener and bearing for the hook 8. The plug includes a detent positioning mechanism best illustrated in FIG. 5. The plug 15 is preferably made of nylon or other hard synthetic, self-lubricating material. It has disk-shaped head 16 which is nested in a circular cavity of the sole 10. The stem 18 of the plug penetrates the hollow core of the hook 8 and is secured to it by a screw 19 passing through one of at least two bores 20, 21 in the side of the shank 14. The height of the arcuate brace portion 22 of the hook in relation the upper surface of the snowboard 5 can thus be adjusted by inserting the screw 19 through either one of the two bores 20, 21. The hook is maintained in either of two positions by means of a nib **22*a* projecting from the sidewall of the circular cavity 17 to engage either one of two notches 23, 24 cut into the periphery of the head 16 of the plug, 90 degrees apart from each other. When subjected to a certain amount of lateral pressure, the hook 8 will swivel between one position to the other as the relatively soft material of the head 16 of the plugs allows the nib *22a* to escape from one of the two notches 23, 24**.

It should be noted that while the most distal portion of the hook is shown espousing the arched outline of a boot tip, a square triangular or simply horizontal configuration would constitute an acceptable equivalent.

A second embodiment of a hook assembly 25 is illustrated in FIGS. 6–9. In this embodiment, the base 26 consists of a small sole plate 27 which extends only slightly under part of the adjacent boot-binding fixture 28, and a hook-mounting pillar 29 attachable to the side 30 of the boot-binding fixture. The hook 31 is fixedly secured into the pillar by a screw 32 passing through a threaded bore in the side of the pillar, and engaging one of a series of holes 33 in the side of the hook shank 34. A vertical slotted channel 35 running along the pillar 29 holds a nut 36 which is engaged by a screw 37 passing through the side 30 of the boot-binding fixture. The base 26 can also be secured directly to the top surface of a snowboard by screws driven through 3 bores 38, 39, 40 in the sole plate 27.

Either one of the above-described embodiments can be used, not only to facilitate the transport of the snowboard while riding a ski-lift and ease the landing when getting off the ski-lift, but can also be used when riding the board down a slope in a free style allowing various positions with one or both feet secured to the board.

While the preferred embodiments of the invention have been described, modifications can be made and other embodiments may be devised without departing from the spirit of the invention and the scope of the appended claims.

What is claimed is:

1. In combination with at least one boot-binding fixture mounted on the top surface of a snowboard wherein said snowboard is elongated along a longitudinal axis, and said boot-binding fixture is angularly oriented in relation to said axis, means for supporting said snowboard with a user's boot, said means comprising a lever having a shank fixedly secured on said snowboard, and a brace projecting from an upper area of said shank and defining an open arch, said brace being shaped and dimensioned to allow the insertion of a tip of said boot between said brace and said top surface; and wherein said brace is sized and dimensioned to bear on said boot and thereby provide support to said snowboard.

2. The combination of claim 1, wherein said lever is positioned proximally to a medial portion of said boot-binding fixture.

3. In combination with at least one boot-binding fixture mounted on the top surface of a snowboard wherein said snowboard is elongated along a longitudinal axis, and said boot-binding fixture is angularly oriented in relation to said axis, a board support means which comprises:

a lever having a shank fixedly secured on said snowboard, and a brace projecting from an upper area of said shank and defining an open arch, said brace being shaped and dimensioned to allow the insertion of a boot tip between said brace and said top surface;

wherein said lever is positioned proximally to a medial portion of said boot-binding fixture; and wherein said lever comprises a base and a plate projecting under said boot-binding fixture.

4. The combination of claim 3, wherein said base has a tubular cavity extending through a portion of said base orthogonally to said top surface, and further comprises means for swivelingly mounting said shank into said tubular cavity.

5. The combination of claim 4, wherein said means for swivelingly mounting comprises means for releasably holding said brace into a plane substantially perpendicular to said top surface, and parallel to the longitudinal axis of said snowboard.

6. The combination of claim 2, wherein said lever comprises means for securing said shank to said boot-binding fixture.

* * * * *